United States Patent [19]

Knowles et al.

[11] 4,341,420

[45] Jul. 27, 1982

[54] LOUNGE CHAIR

[76] Inventors: William F. Knowles; Larry F. Knowles, both of 835 Milwood Ave., Venice, Calif. 90291; H. LeRoy Oliver, 10735 Cranks Rd., Culver City, Calif. 90230

[21] Appl. No.: 176,714

[22] Filed: Aug. 11, 1980

[51] Int. Cl.[3] ..... A47D 13/10

[52] U.S. Cl. ..... 297/280; 297/69; 297/281

[58] Field of Search ..... 297/280, 281, 282, 84, 297/85, 69, 217

[56] References Cited

U.S. PATENT DOCUMENTS

| | | | |
|---|---|---|---|
| 603,280 | 5/1898 | Stransky | 297/280 X |
| 695,225 | 3/1902 | McKee et al. | 297/281 |
| 827,417 | 7/1906 | Calbeck et al. | 297/69 |
| 953,591 | 3/1910 | Bringham | 297/280 X |
| 1,177,899 | 4/1916 | Rogers | 297/280 |
| 3,781,060 | 12/1973 | Pentzien | 297/217 |

*Primary Examiner*—James T. McCall

*Attorney, Agent, or Firm*—Bruce A. Jagger

[57] ABSTRACT

An articulated frame hanging chair, the frame of which includes an articulated parallelogram in which the exposed scissoring intersections are shielded and the articulation of the frame is adjustably limited to prevent the center of gravity of the hanging chair from shifting so as to dislodge the user in an unsafe manner.

5 Claims, 5 Drawing Figures

LOUNGE CHAIR

Figure 2:
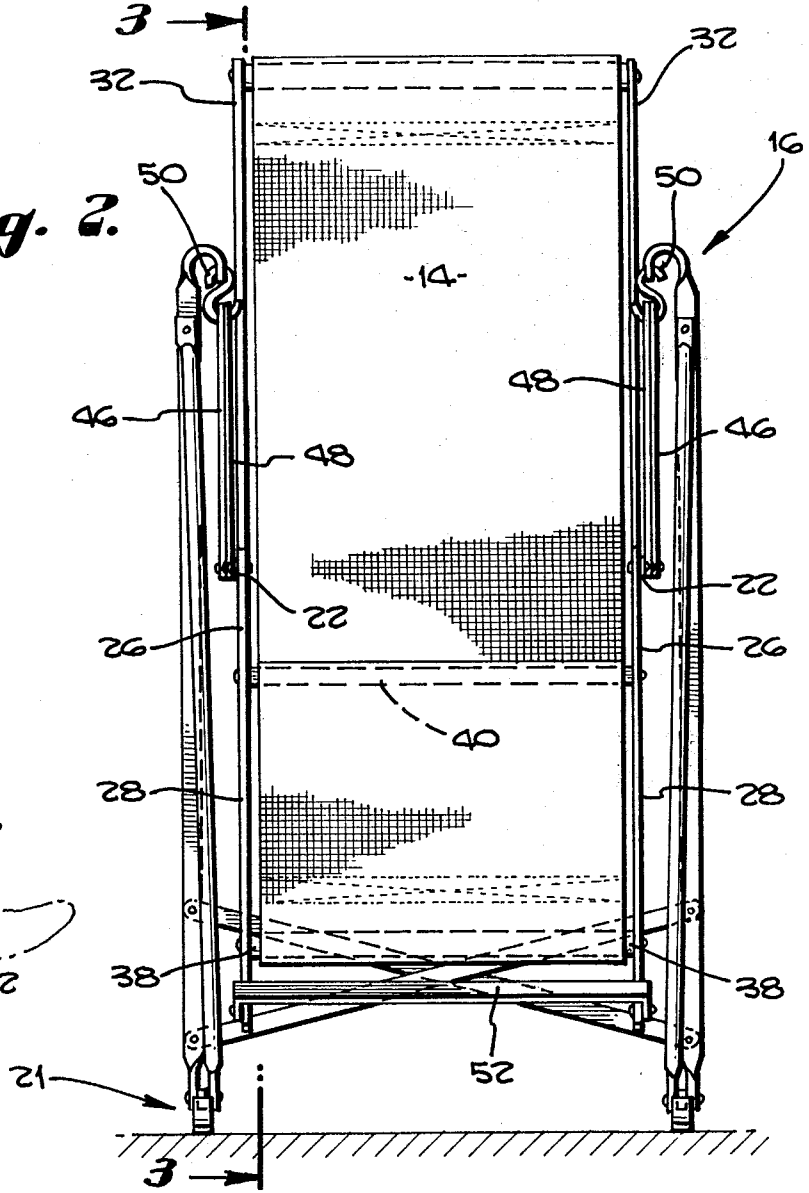

This invention relates to articulated frame hanging chairs which are designed to articulate from a fully upright configuration to a semi-reclining configuration, and more particularly this invention relates to an articulated frame hanging chair in which the articulation system is based on a pair of articulated parallelogram members wherein the end elements of the parallelogram are extended to provide respective leg and back portions. The exposed apexes of the parallelogram members which scissor through angles of less than 90 degrees are shielded so as to prevent injury. The articulation of the frame is limited so as to prevent shifting of the combined center of gravity of the chair and the person seated therein to an unsafe location.

Articulated frame hanging chairs which may be suspended from a pedestal mount or from ceiling or wall mounts have been the source of much relaxation and enjoyment. The articulation of such hanging chairs so as to permit their adjustment from a fully upright to a semi-reclining configuration has further enhanced the enjoyment to be derived from the use of such chairs. Articulation, has, however, resulted in some serious safety problems which had previously detracted from the enjoyment of articulated hanging chairs.

According to the present invention, an articulated hanging chair is provided in which the articulated joints are shielded where there is a risk of pinching or cutting due to the scissoring action of the pivotally connected elements. Also, the articulation of the frame is limited so that the chair may not be extended to the full reclining configuration. Certain adjustments are provided to encourage proper usage of the chair so as to avoid improper positioning of the center of gravity of the occupied chair. The chair is designed to be supported at a location which is well above the normal center of gravity of the combined chair and occupant. The chair is limited and adjusted so that the occupant of the chair is not subjected to the risk of falling from the chair either by reason of its pedestal being overturned or the frame becoming unbalanced so as to allow the user to strike the ground or fall out of the chair.

Articulation of the hanging chair, according to the present invention, is provided by a pair of parallelogram members, the apexes of which are pinned with pivotal connections. The parallelogram member generally includes a pair of normally horizontally extending seat elements and a pair of normally generally upright end elements. The respective end elements are extended in opposite directions from the parallelogram member and provide, respectively, the leg portion and back portion of the chair. The normally lower one of the seat elements is extended outwardly from the parallelogram beyond the pivotal connection with the end element which forms the back portion of the chair. The extended normally lower seat element provides an anchoring point for a web of material which forms the resilient supporting structure for the chair's occupant. The extended web anchoring point permits the web to be maintained under substantially constant tension throughout the articulation limits of the chair. The chair is generally supported by a support element which projects upwardly from the normally upper one of the seat elements.

Conveniently, the support is in the form of a triangle, the base of which is formed by the normally upper one of the seat elements. The triangulated structure provides a structural rigidity which is preferred. With a rigid support structure the articulation of the chair is accomplished by movement at the pivotal connections of the parallelogram members, rather than at some undesired location due to flexure in the support member. The safety of the structure is thus enhanced. Also, the presence of a triangulated support structure provides a rigid mount for a tether or other articulation limiting element. Where support for the chair is provided by a pedestal, the utility of the chair is enhanced becuase it may be positioned at any desired location without reference to the immediate availability of some structure from which the chair may be hung. There is, however, an increased need for safety measures in limiting the articulation of the frame so as to prevent the upsetting of the supporting pedestal.

The web material which provides the primary supporting surface for an occupant of the chair is conveniently selected from those materials such as canvas, woven webbing and the like, which, when stretched taut on the frame of the chair, are capable of resiliently and comfortably supporting a person.

In general the chair includes two substantially similar articulated parallelogram members with extended elements, which are held in spaced-apart relationship by a plurality of laterally extending spacer elements. Preferably, one of the spacer elements is positioned so as to extend between the ends of the normally lower seat elements so as to define the front of the chair seat. Another one of the laterally extending elements extends between the outer ends of the extended normally lower seat elements so as to provide an anchoring point for the web. Laterally extending elements also are generally provided at the outermost ends of the extended end elements of the parallelogram members so as to define the terminus of the respective back and leg portions of the chair. An adjustable foot rest is conveniently provided on the leg portion of the chair so as to safely accommodate persons of different heights.

Figure 1:
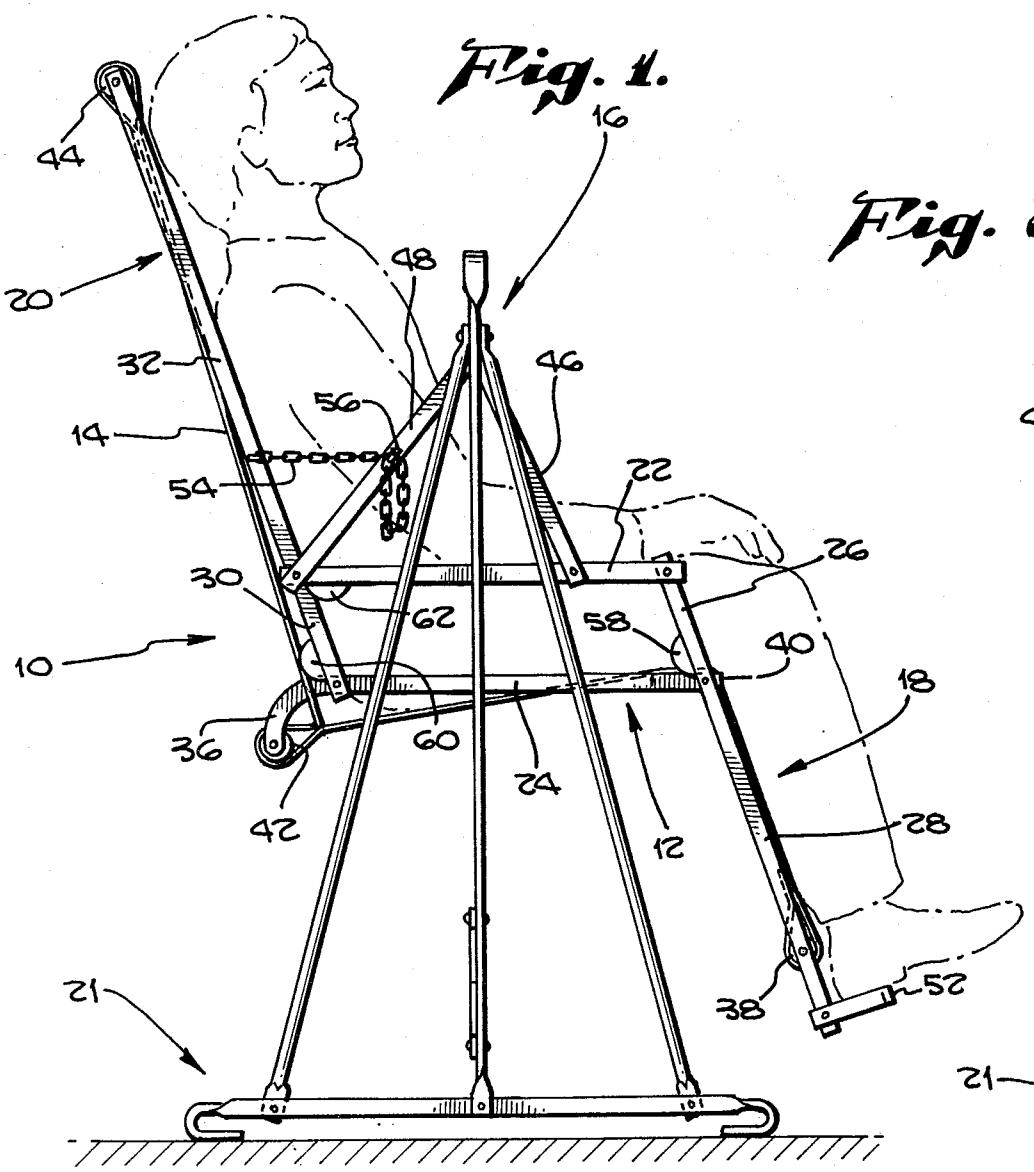
Figures 3, 4, 5:
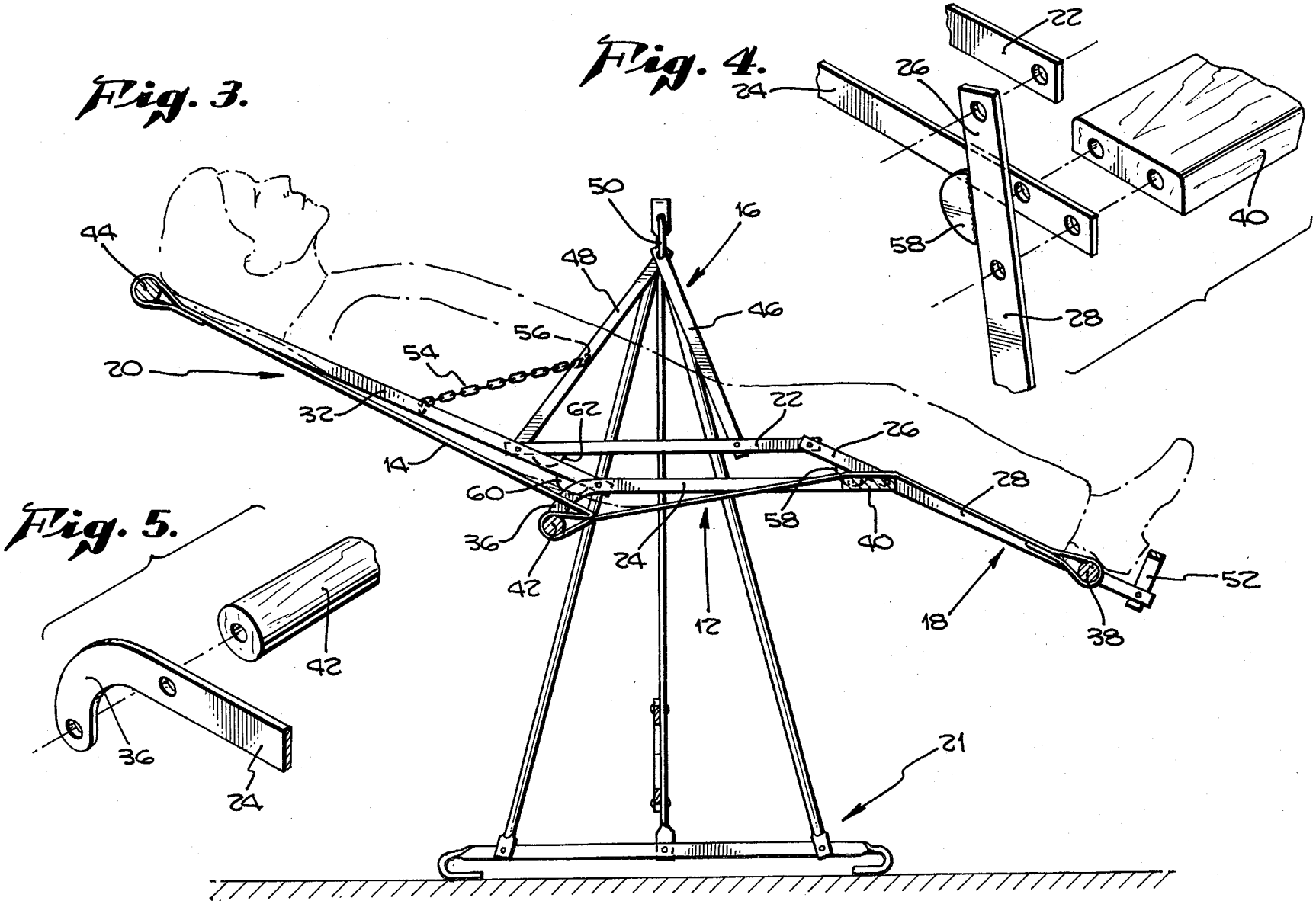

Reference is made to the accompanying drawings for the purposes of illustration only and not limitation, where there is illustrated:

FIG. 1, a side elevational view of an articulated frame hanging chair according to the present invention;

FIG. 2, is a front elevational view of the chair illustrated in FIG. 1;

FIG. 3, a cross-sectional view taken along line 3—3 in FIG. 2;

FIG. 4, an exploded perspective view of a portion of a typical articulated parallelogram member; and FIG. 5, an exploded partial perspective view of the web-anchoring structure in an articulated frame hanging chair according to the present invention.

Referring to the drawings, there is illustrated particularly at 10 an articulated frame hanging chair which includes a typical parallelogram member 12, a supporting web 14, a typical triangulated support structure 16, a leg portion 18 and a back portion 20. Chair 10 is supported in operative position by a pedestal 21. The chair 10 articulates between the configurations illustrated in FIGS. 1 and 3 by reason of the pivotal connections at the intersections of the parallelogram members. The elements which form the parallelogram member are extended so as to provide the leg and back portions for the chair. A supporting web 14 is stretched over the articulated frame so as to provide support for the occupant. The chair 10 is suspended from attachment points on pedestal 21 by means of links or S hooks.

A typical parallelogram member illustrated generally at 12 includes a pair of generally parallel extending seat elements and a pair of generally parallel extending end elements. The normally upper seat element 22 and the normally lower seat element 24 generally extend horizontally. The first end element 26 generally extends parallel to second end element 30. The extension 28 of first end element 26 defines leg portion 18. The extension 32 of second end element 30 provides back portion 20. Normally lower seat element 24 is extended beyond second end element 30 outwardly from the parallelogram member 12 and provides an anchoring end 36.

A plurality of transversely extending elements serves to space the substantially similar parallelogram members apart and maintain them in the desired operative relationship. The laterally extending members also support and provide definition for the supporting web 14. A leg lateral element 38 extends between the extensions 28 and provides an anchoring point for the normally lower end of web 14. A seat lateral element 40 defines the front edge of the seat and supports web 14. Anchoring web element 42 provides an anchoring point for web 14 in such a position that web 14 retains the required degree of tension throughout the permitted articulation of parallelogram member 12. Head lateral element 44 supports extended elements 32 in the desired spaced-apart relationship and serves as the normally uppermost anchoring point for web 14.

Typical triangulated support structure 16 includes a base which is a portion of normally upper seat element 22, a first leg 46 and a second leg 48. The normally upper apex where first and second legs 46 and 48 intersect is connected by means of link 50 to pedestal 21. Link 50 permits chair 10 to swing in a pleasing fashion when propelled by the user or someone cooperating with the user.

An adjustable foot rest 52 is provided so as to support the feet of a user in a comfortable position. The provision of a foot rest which is readily adjustable to proper position for the user contributes to the safety of the device in that the user tends to be comfortably positioned in the proper location for maximum stability of the device. Shifting the user's weight to the forward portion of the seat near seat lateral element 40 positions the center of gravity of the combined chair and occupant at a location where the chair tends to tip so that a person may slide out of it in a forward direction. This forward shifting of the center of gravity naturally occurs when a person moves forward in the chair so as to reach a foot rest which is improperly positioned at too low a location.

The articulation of the chair frame through the pivoting of the parallelogram member is limited by a flexible tether or safety chain 54. One end of tether 54 is attached by welding or other permanent means of fixation to extended element 32 and the other end is likewise permanently attached to second leg 48 of triangulated support structure 16. At its fully extended configuration, tether 54 stretches to its full length between its two attached ends. This configuration is illustrated, for example, in FIG. 3. In a retracted configuration, such as is illustrated, for example, in FIG. 1, the tether 54 is linked at some intermediate point between its fixed ends to hook 56. Securing tether 54 at some intermediate point to hook 56 prevents the articulation of the frame to a more reclined configuration.

The articulation of parallelogram member 12 from the generally upright configuration illustrated in FIG. 1 to the semi-reclining configuration illustrated in FIG. 3 results in a scissoring action between those parallelogram elements which move through angles of less than 90 degrees. This scissoring action provides a safety hazard in that portions of the user's anatomy may become pinched between the parallelogram elements as they move through declining angles of less than 90 degrees. In order to prevent injury due to this inevitable scissoring action, a plurality of shields is provided. Leg shield 58 is provided between the outer end of normally lower seat element 24 and first end element 26 so that the pivoting of these elements about their pivotal connection element will not result in pinching a person seated in the chair. Likewise, seat shield 60 protects the user from harm, while second end element 30 and extended element 34 pivot about their connector element through a declining angle. Arm shield 62 protects the user from the scissoring action of seat element 22 and second end element 30 as they pivot around their connector point. All of the apexes of the parallelogram member 12 are pivotally connected and shields are provided wherever those pivotal connections are exposed to a user in such a way that harm might occur during the pivotal action. Tether 54 is selected so that at its fully extended configuration it will not allow parallelogram member 12 to collapse fully so as to bring elements 22 and 24 together.

The pedestal 21 is triangulated both in the axial and transverse directions so as to provide maximum rigidity with a minimum of structure and interference with the operation of the chair.

What have been described are preferred embodiments in which modifications and changes may be made without departing from the spirit and scope of the accompanying claims.

What is claimed is:

1. An articulated frame hanging chair comprising:

an articulated frame including elongated elements pivotally connected to define a pair of spaced-apart articulated parallelogram members, each said parallelogram member including a pair of normally horizontally extending seat elements spaced apart from one another in a generally parallel relationship, and a pair of end elements spaced apart from one another in a generally parallel relationship, said seat elements and end elements being pivotally connected to form said parallelogram member, a first one of said end elements being extended outwardly beyond said parallelogram member in a first direction to define a leg portion of said articulated frame, a second one of said end elements being extended outwardly beyond said parallelogram member in a second direction to define a back portion of said articulated frame, a plurality of laterally extending spacer elements extending between said parallelogram members, a pair of support elements extending normally upwardly from the normally upper one of said seat elements to define therewith a triangular structure, a first one of said support elements pivotally connected at one end to the pivotal connection between said second one of said end elements and said normally upper one of said seat elements, means at the normally uppermost apex of said triangular structure for swingably connecting said chair to a support, adjustable articulation limiting means extending between said first one of said support elements and said back portion to adjustably limit the articulation of said articulation frame, and shield means for preventing injury positioned at the exposed apexes of said parallelogram members where the said elongated members normally articulate through an angle of less than ninety degrees.

2. An articulated frame hanging chair according to claim 1 including adjustable foot rest means for supporting the feet of a person seated in said chair.

3. An articulated frame hanging chair according to claim 1 including pedestal means for connection to said means for swingably connecting to support said chair.

4. An articulated frame hanging chair according to claim 1 including web means stretched over said articulated frame for supporting a person seated in said chair, the normally lower one of each of said seat elements being extended outwardly from said parallelogram beyond said second end element and terminating in an anchoring end, one of said laterally extending spacer elements extending between said anchoring ends, said web means being anchored to said one laterally extending spacer element.

5. An articulated frame hanging chair according to claim 1 wherein said articulation limiting means includes a link chain.

* * * * *